US005369963A

United States Patent [19]

Pickles et al.

[11] Patent Number: 5,369,963

[45] Date of Patent: Dec. 6, 1994

[54] TOP MOUNT REFRIGERATOR WITH AIR TOWER AND BAFFLE IN AIR CIRCULATION SYSTEM

[75] Inventors: Ernest C. Pickles; Adrian I. Micu, both of Evansville, Ind.

[73] Assignee: Whirlpool Corporation, Benton Harbor, Mich.

[21] Appl. No.: 120,803

[22] Filed: Sep. 15, 1993

[51] Int. Cl.[5] ..... F25D 17/08

[52] U.S. Cl. ..... 62/408; 62/444

[58] Field of Search ..... 62/408, 187, 417, 444, 62/447

[56] References Cited

U.S. PATENT DOCUMENTS

| | | | |
|---|---|---|---|
| 4,28,720 | 8/1981 | Stottman et al. | 62/180 |
| 3,216,217 | 11/1965 | Kesling | 62/289 |
| 3,445,119 | 5/1969 | Andresen et al. | 277/3 |
| 3,445,119 | 7/1969 | Bright | 62/180 |
| 3,638,449 | 2/1972 | Lichtenberger | 62/272 |
| 4,229,945 | 10/1980 | Griffin et al. | 62/229 |
| 4,296,611 | 10/1981 | Griffin et al. | 62/89 |
| 4,614,092 | 9/1986 | Kim et al. | 62/408 |
| 4,646,531 | 3/1987 | Song | 62/187 |
| 4,662,186 | 5/1987 | Park | 62/265 |
| 4,704,874 | 10/1987 | Thompson et al. | 62/187 |
| 4,768,353 | 9/1988 | Bushser | 62/408 |
| 4,920,765 | 5/1990 | McCauley et al. | 62/408 |
| 4,944,157 | 7/1990 | Jenkins et al. | 62/407 |

*Primary Examiner*—William E. Tapolcai

*Attorney, Agent, or Firm*—Hill, Steadman & Simpson

[57] ABSTRACT

An air circulation system in a two compartment refrigeration device is provided wherein a restriction device in the form of movable baffles is located in an air conduit connecting the two compartments. The baffles are held in a factory pre-set position by a detent arrangement and the baffles can be selectively moved relative to one another in a non rotatable fashion, such as linearly by service personnel in order to change the ratio of air flowing into the two compartments.

22 Claims, 3 Drawing Sheets

TOP MOUNT REFRIGERATOR WITH AIR TOWER AND BAFFLE IN AIR CIRCULATION SYSTEM

BACKGROUND OF THE INVENTION

The present invention relates to domestic refrigerators and more particularly to an air circulation system for a refrigerator cabinet.

Conventional frostless-type refrigerators utilize forced refrigerated air flow to cool fresh food and freezer compartments. An electric fan draws refrigerated air across an evaporator coil with most of the air being forced into the freezer compartment and then returned to the evaporator. Some of the refrigerated air is delivered to the fresh food compartment through an air inlet opening therein. An adjustable damper is sometimes provided in the air inlet opening to adjust the amount of air directed into the refrigeration compartment to effect a greater or lesser amount of cooling.

Traditionally the control system for a top mount freezer/refrigerator consists of a separate control for each of the freezer and fresh food compartments. The control for the fresh food compartment is a sensing device (thermostat) located in the fresh food compartment which reacts to the supply air directed across it. The freezer section is governed by the relationship between the thermostat and the ratio of air directed into the freezer compartment. The ratio can be varied by an adjustable baffle which is located in the communicating duct between the freezer and fresh food compartments. By changing the baffle position, the air ratio between the two compartments is varied with a net result being that the freezer temperature is modified. However, the freezer temperature is also modified if the set point of the thermostat governing the fresh food compartment is changed. When the thermostat position is changed, the times required to fulfill the cooling needs of the fresh food compartment are modified, resulting in either a reduction or increase in the cooling system on/off time. Since the thermostat is the control for the cooling system, the fresh food compartment will be satisfied and the freezer section will only cool to a temperature governed by the air ratio and the cooling system run time.

U.S. Pat. No. 4,614,092 discloses an air baffle located in the refrigerator compartment which can be adjusted for varying the air flow into the refrigerator compartment.

U.S. Pat. No. 4,920,765 discloses a rotatable valve for controlling the amount of cooled air flowing from the freezer to the refrigerator compartment.

SUMMARY OF THE INVENTION

The present invention is directed to an air flow and control system for a refrigerator which is built with a "double-tub" plastic liner. The "double-tub" design means that two separate liners for the refrigerator compartment and freezer compartment are formed separately and are inserted into a metal outer wrapper prior to the introduction of an insulating foam between the compartments and the metal wrapper. The two compartments are also separated by a layer of insulating foam.

The present invention utilizes a single control which is similar to a dual control in that it uses a thermostat to control the fresh food compartment and the freezer section is controlled by an air flow ratio between the two compartments. The difference is that on a single control the air ratio is preset before the product leaves the factory and is non-consumer adjustable. In order to modify the freezer compartment temperature, a change to the thermostat position is required. However, when the thermostat position is changed it will also effect a temperature change in the fresh food compartment. Since the freezer cannot be independently controlled, the temperature profile, if graphed, follows a straight angled line.

Because the product only has one consumer accessible control, involvement required from the consumer is limited. This is a benefit in that the consumer has a readily accessible control in the thermostat which will control both compartments. The single control eliminates the need for the consumer to try and decipher how the unit is to be set up for proper operation.

In the event that a consumer requires a freezer temperature which is not obtainable with the preset ratio and thermostat control, it will be possible to modify the temperature line in the field. The duct which will communicate between the fresh food and freezer compartments will have a non-consumer adjustable baffle in it. If a change is required, a service technician can modify the air flow ratio by linearly moving the baffle into one a plurality of different positions.

DETAILED DESCRIPTION OF THE PREFERRED EMBODIMENTS

Figure 1:
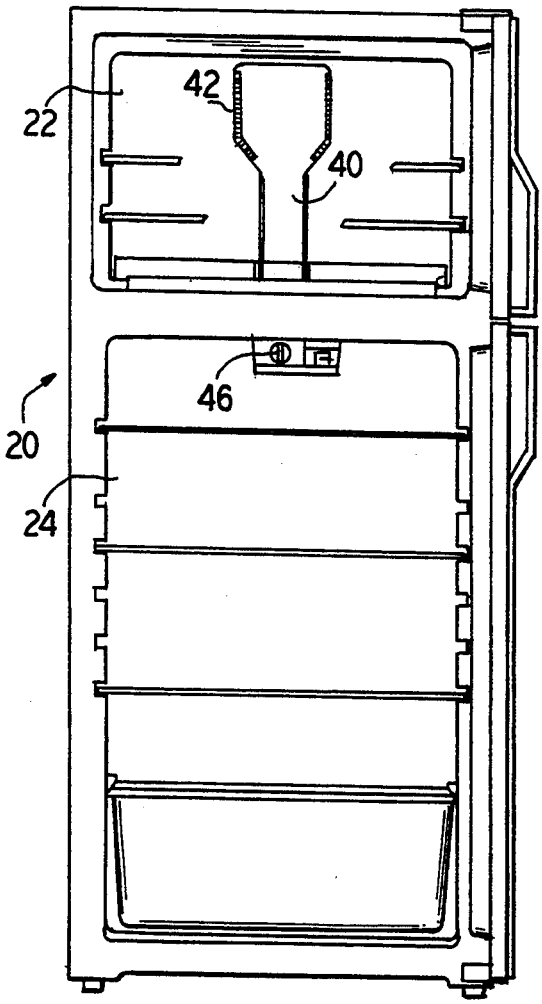
FIG. 1 is a front elevational view of a top mount refrigerator/freezer embodying the principles of the present invention with the doors open.
Figure 2:
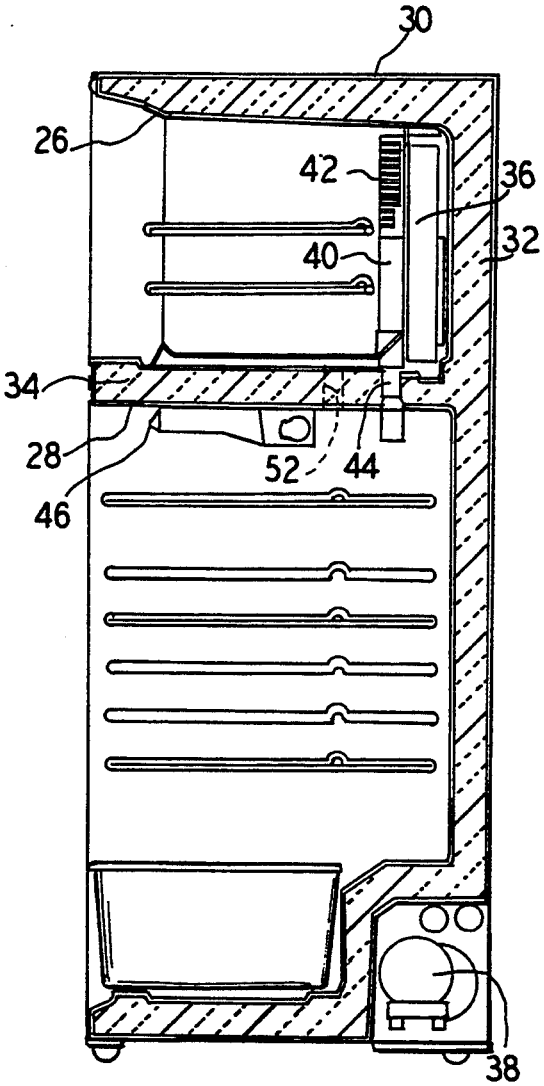
FIG. 2 is a side sectional view of the refrigerator/-freezer of FIG. 1 with the doors removed.
Figure 6:
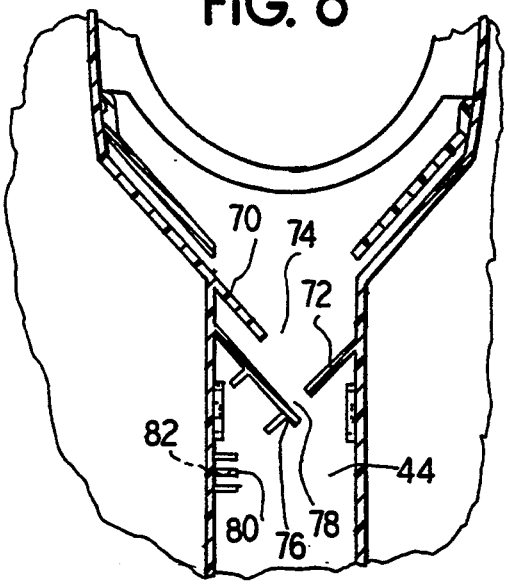
FIG. 6 is a partial front sectional view of the air tower with a baffle in the factory preset position.
Figure 7:
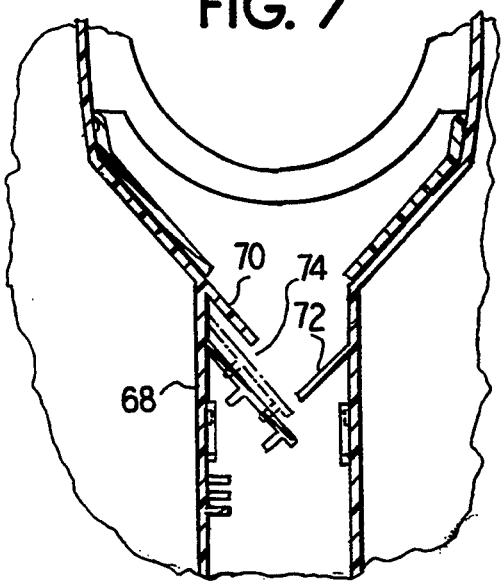
FIG. 7 is a partial front sectional view of the air tower with the air baffle moved to a more restricting position.
Figure 4:
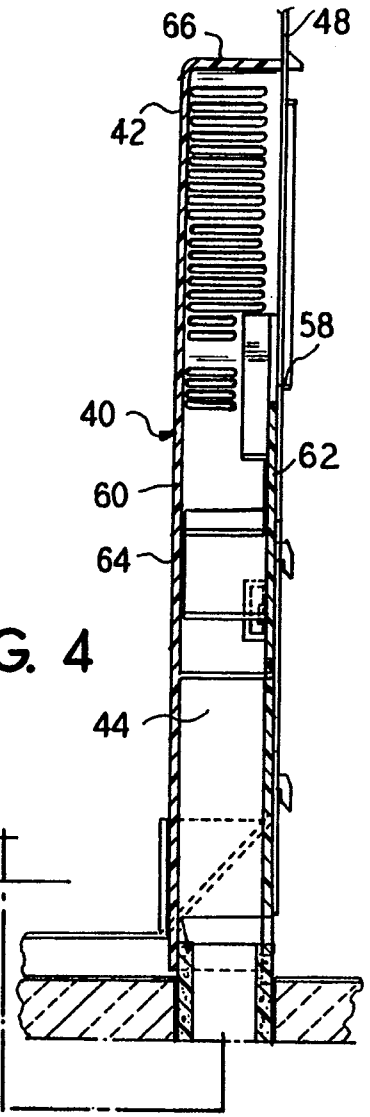
FIG. 4 is a side sectional view through the air tower.
Figure 3:
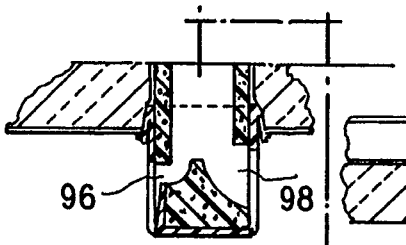
FIG. 3 is an exploded view of portions of the freezer compartment and air flow system.
Figure 3:
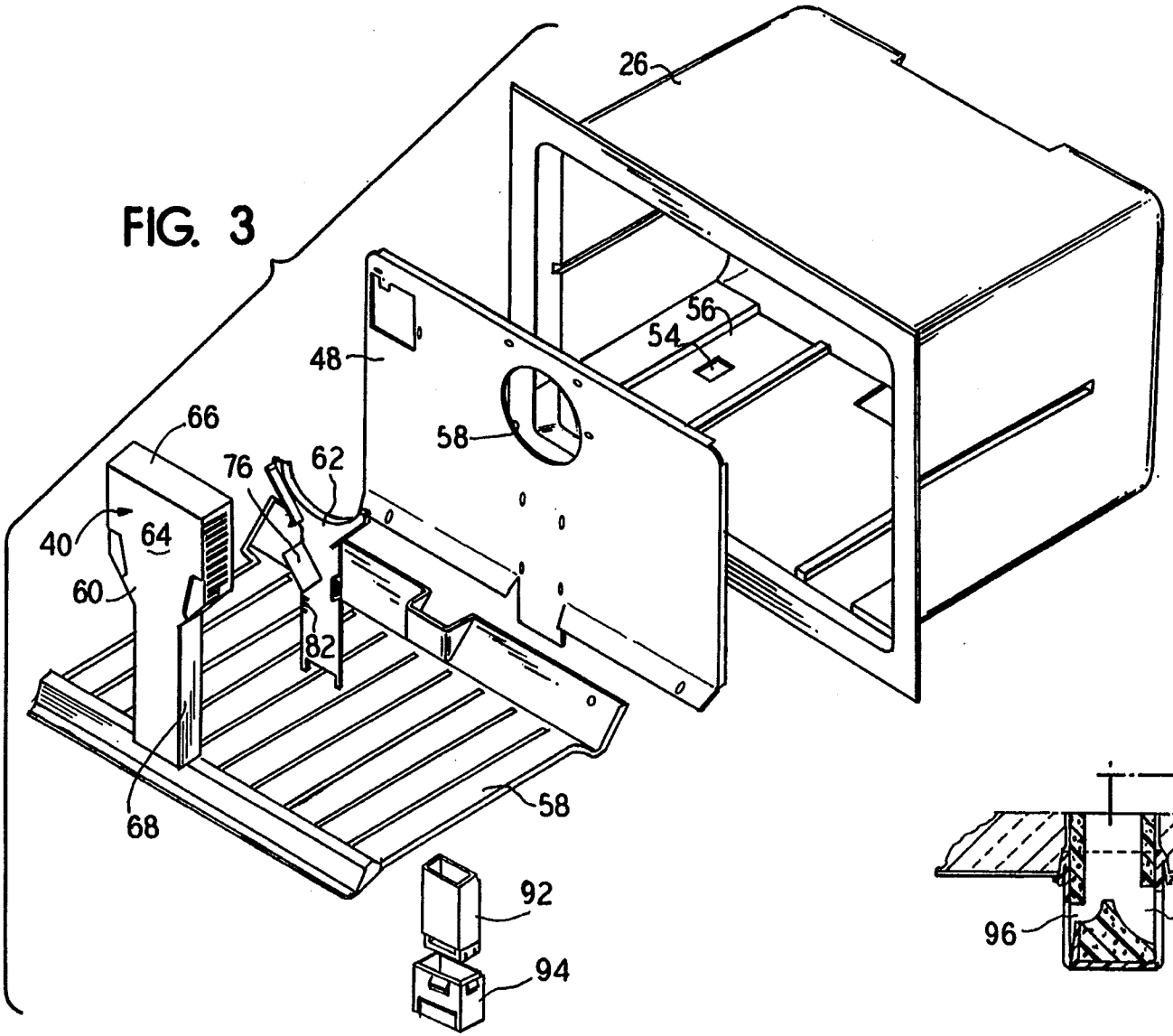

In FIGS. 1 and 2 there is illustrated a top mount refrigerator/freezer appliance generally at 20 which includes a freezer compartment 22 on or above a refrigerator or fresh food compartment 24. The freezer compartment is defined by a liner 26 and the fresh food compartment is defined by a liner 28. These liners are placed within an outer metal shell 30 and the intervening space between the shell 30 and the liners 26, 28 is filled with an insulating foam 32. The insulating foam also extends in a space 34 between the freezer liner 26 and the fresh food liner 28.

Cooling within the compartments 22, 24 occurs through the provision of a refrigerant supplied to an evaporator 36 from a compressor 38. Air is directed by a fan (not shown) to flow over the evaporator 36 to cool the air which is then directed into the freezer compartment 22 and refrigerator compartment 24. The air from the evaporator 36 is discharged into an air tower 40 where the air flow is split into two streams, one stream flowing into the freezer compartment through apertures 42 in the air tower and the other stream being directed down to the fresh food compartment through a duct 44 in the air tower. Temperature within the refrigerator compartment is controlled by an adjustable thermostat (not shown) which can be user adjustable through use of a control knob 46.

One or more return air ducts 52 pass through the insulated space 34 between the freezer liner 26 and fresh food compartment liner 28 and exit through openings 54 in the freezer compartment liner 26. These openings 54 are positioned in a channel 56 positioned below a bottom plate 58 in the freezer compartment 22 and the channels communicate with a space behind the evaporator cover 48 to allow for a commingling of the return air from the freezer compartment 22 and fresh food compartment 24 in the cooling space occupied by the evaporator 36 located behind evaporator cover 48. All of the chilled air which has flown across the evaporator 36 exits from the space through an opening 58 in the evaporator cover 48 to flow into the air tower 40.

The air tower 40 is comprised of a front member 60 and a rear member 62. The front member 60 comprises a substantially solid front wall 64, a solid top wall 66 and side walls 68. Near a top of the side wall 68 are the openings 42 through which chilled air is directed into the freezer compartment 22. The rear member 62 comprises a solid wall which encloses the back side of the front member 60 and which forms the air conduit 44 in the lower portion of the tower 40.

In the preferred embodiment illustrated in FIGS. 4–7, the front member has a pair of fixed internal baffles 70, 72 (FIGS. 6, 7) which direct air to flow through a gap 74 between the two baffles into the conduit 44 leading toward the fresh food compartment 24. A third baffle 76 is carried on the rear member 62 and it defines a second gap 78 through which the air must flow to the conduit 44. The position of the third baffle 76 relative to the first and second baffles 70, 72 is determined by means of a detent means in the form of a key 80 which is formed on the front member 60 and which extends into a slot 82 formed in the rear member 62.

Figure 5:
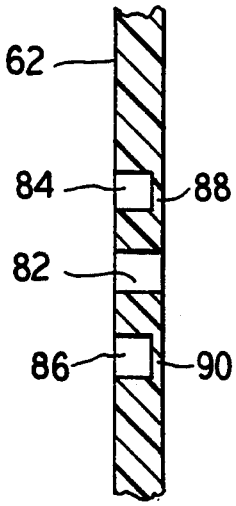
FIG. 5 is a partial side sectional view of the air tower rear wall.

As seen best in FIG. 5, a single slot 82 is formed in the rear member 62 so that the third baffle 76 will be factory preset in a specific spacing relative to the first and second baffles 70, 72. Two additional partial slots 84, 86 are provided above and below the through slot 82. A service technician can remove the thin web 88, 90 covering one of the partial slots 84, 86 so that the position of the rear member 62 can be vertically shifted relative to the front member in a linear manner, thereby changing the size of the gap 78 between the second baffle 72 and the third baffle 76. By shifting the rear member 62 down, the gap 78 will be made larger thus resulting in a higher ratio of air flow being directed into the refrigerator compartment 24 and thus a smaller temperature differential between the refrigerator compartment and the freezer compartment. By shifting the rear member 62 upwardly, the gap will be made smaller, thereby reducing the ratio of air flow to the refrigerator compartment and increasing the temperature differential between the refrigerator compartment and the freezer compartment.

The air which has passed through the second gap 78 continues through the conduit 44 and into an air diffuser 92 which is held in place by a snap cap 94. The air diffuser 92 and cap 94 have a front opening 96 and a rear opening 98 to allow air to be diffused into the fresh food compartment 24.

Figure 8:
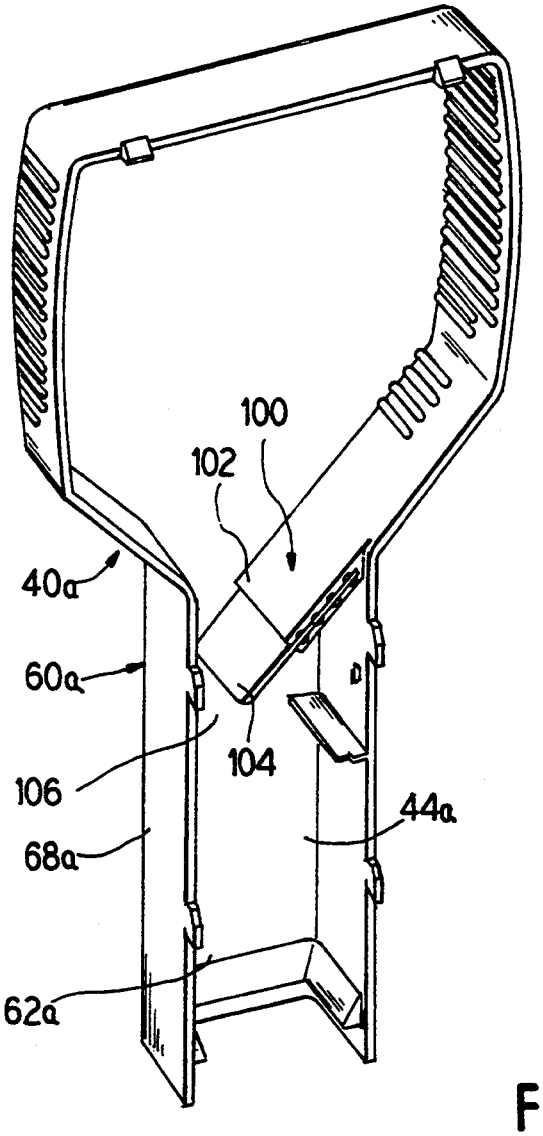
FIG. 8 is a perspective view of an alternate embodiment of an adjustable baffle.
Figure 9:
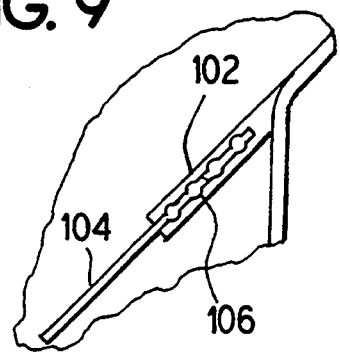
FIG. 9 is a partial elevational view of the baffle of FIG. 8.

An alternate embodiment of an air tower is shown at 40*a* in FIGS. 8 and 9. In most respects, the construction of a front member 60*a* is the same as that described above, with the exception being the area of the internal baffles. In the alternate embodiment, a single baffle 100 is provided which has a fixed portion 102 and a linearly slidingly movable portion 104. A detent arrangement 106 is provided between the fixed baffle 102 and the movable baffle 104 to permit the movable baffle to be selectively placed in one of a plurality of specific positions. The movable baffle 104 will define a gap 106 between the end of the movable baffle and a side wall 68*a* of the front member 60*a*. In this embodiment, the rear member would merely be the evaporator cover 48.

As above, as the movable baffle 104 has its position changed, the temperature differential between the freezer compartment and the fresh food compartment will be changed.

Figure 10:
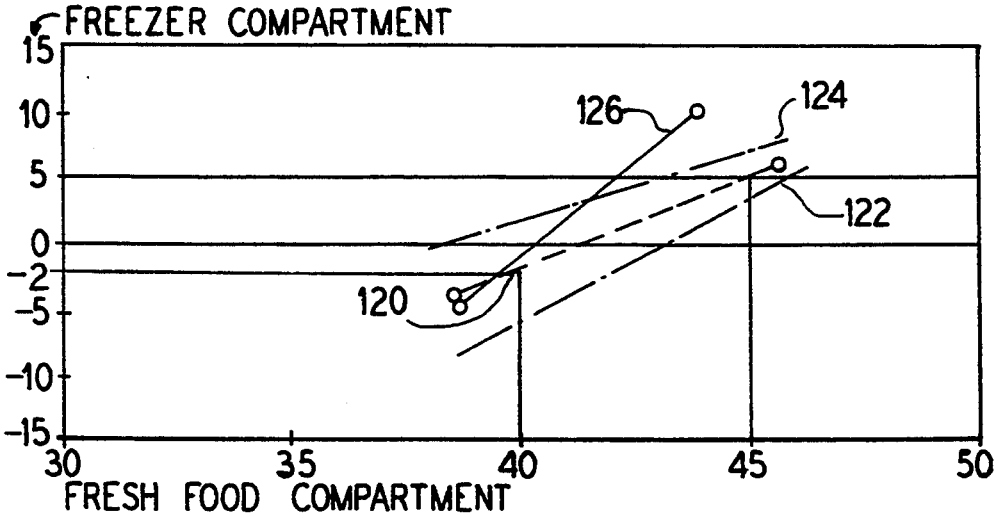
FIG. 10 is a graphic representation of energy intercepts comparing single control versus dual control air flow systems.

FIG. 10 is a graphic representation of the comparison of the freezer compartment temperature noted along the vertical axis with the fresh food compartment temperature noted along the horizontal axis. Dashed line 120 represents the temperatures achieved by using the single control arrangement of the present invention wherein the adjustable thermostat is used to select the temperature for the fresh food compartment. Since the air ratio is preset, the temperature profile is represented by a straight angled line. Thus, if the user operated the thermostat to achieve a temperature of 40° F. within the fresh food compartment, a temperature of approximately −2° F. would be achieved in the freezer compartment. Similarly, a selection of 45° F. in the fresh food compartment would result in a temperature of 5° F. in the freezer compartment. If the user determined that this temperature differential was too small and therefore the freezer temperature too warm, the service technician could adjust the baffle within the air tower to achieve a greater differential resulting in a colder freezer temperature as represented by the dash and dot line 122. Thus, when the fresh food compartment is set at 45° F. the temperature in the freezer compartment would be approximately 4° F. and when the temperature in the fresh food compartment is lowered to 40° F., the increased ratio would cause an even greater differential and the freezer compartment temperature would be lowered to less than −5° F.

Conversely, if the temperature differential were desired to be lowered (warmer freezer) the service technician could make the appropriate adjustment to the baffles to achieve the dashed and dot line profile represented by line 124.

Solid line 126 represents a temperature profile which could be achieved with a dual control refrigerator freezer. Typically mandated energy reporting procedures relating to energy consumption require that these refrigeration units be tested with controls set at their midpoints and then, depending on the resulting operating conditions, the controls are set to either the warm/warm or cold/cold settings. Energy is then reported at the intersection of either 5° F. freezer or 45° F. fresh food compartment temperatures, after interpolating between the two points. The advantage of a single control is that it is possible to report minimum energy consumption without comprising temperature performance at other control settings.

Ideally minimum energy consumption would occur at the point 5° F. and 45° F. However, if the air ratio is modified to allow a dual control to intersect at this point, the performance at the midpoint would be poor. Since the single control varies the freezer temperature and fresh food temperature at the same time, it is possible to intersect at this point without affecting the performance of the unit at its thermostat mid position.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An air circulation system for use in a directing air between two separate compartments a comprising:

an air conduit extending between said two compartments;

means for introducing a flow of air into said conduit from exterior of said two compartments;

openings in said air conduit communicating with each of said compartments;

restriction means in said air conduit to establish a fixed ratio of the air flowing into each of the compartments;

said restriction means being selectively non-rotatably movable to vary said ratio; and detent means being provided to selectively hold said restriction means in a fixed position.

2. An air circulation system according to claim 1, wherein said restriction means comprises at least one movable baffle.

3. An air circulation system according to claim 1, wherein said restriction means comprises baffles removably fixed to walls of said conduit wherein at least one wall is linearly movable.

4. An air circulation system according to claim 1, wherein said restriction means are linearly movable.

5. An air circulation system according to claim 1, wherein said detent means permit selective movement and repositioning of said restriction means.

6. An air circulation system for use in a refrigeration device having two separate compartments and an air chilling apparatus, comprising:

an air conduit extending between said air chilling apparatus and said two compartments;

air moving means to cause said chilled air to flow from said air chilling apparatus to said air conduit;

openings in said air conduit communicating with each of said compartments;

a plurality of baffles in said air conduit to establish a fixed ratio of the air flowing into each of the compartments;

at least one of said baffles being selectively non-rotatably movable to vary said ratio, said at least one of said baffles immovably fixed to a wall of said conduit and said wall being linearly movable.

7. An air circulation system for use in a refrigeration device having two separate compartments and an air chilling apparatus, comprising:

an air conduit extending between said air chilling apparatus and said two compartments;

air moving means to cause said chilled air to flow from said air chilling apparatus to said air conduit;

openings in said air conduit communicating with each of said compartments;

a plurality of baffles in said air conduit to establish a fixed ratio of the air flowing into each of the compartments;

at least one of said baffles being selectively non-rotatably movable to vary said ratio; and wherein all of said baffles are immovably fixed to walls of said conduit.

8. An air circulation system for use in a refrigeration device having two separate compartments and an air chilling apparatus, comprising:

an air conduit extending between said air chilling apparatus and said two compartments;

air moving means to cause said chilled air to flow from said air chilling apparatus to said air conduit;

openings in said air conduit communicating with each of said compartments;

a plurality of baffles in said air conduit to establish a fixed ratio of the air flowing into each of the compartments;

at least one of said baffles being selectively non-rotatably movable to vary said ratio; and wherein detent means are provided to hold a first of said baffles in a fixed position relative to a second of said baffles.

9. An air circulation system according to claim 8, wherein at least one of said baffles is immovably fixed to a wall of said conduit.

10. An air circulation system according to claim 9, wherein said wall is linearly movable.

11. An air circulation system according to claim 8, wherein at least one of said baffles is slidably attached to another one of said baffles.

12. An air circulation system according to claim 8, wherein said detent means permit selective movement and repositioning of said first baffle relative to said second baffle.

13. An air circulation system according to claim 8, wherein said at least one of said baffles is linearly movable.

14. A refrigeration device comprising:

a first and second compartment to be air chilled, an air chilling apparatus, a thermostat positioned in one of said compartments to control operation of said air chilling apparatus, an air conduit extending between said air chilling apparatus and said two compartments, air moving means to cause said chilled air to flow from said air chilling apparatus to said air conduit, at least one opening in said air conduit communicating with each of said compartments, a plurality of baffles in said air conduit to establish a fixed ratio of the air flowing into each of the compartments, at least one of said baffles being selectively non-rotatably movable to vary said ratio, wherein detent means are provided to hold a first of said baffles in a fixed position relative to a second of said baffles.

15. A refrigeration device according to claim 14, wherein at least one of said baffles is immovably fixed to a wall of said conduit.

16. A refrigeration device according to claim 15, wherein said wall is linearly movable.

17. A refrigeration device according to claim 15, wherein all of said baffles are immovably fixed to walls of said conduit.

18. A refrigeration device according to claim 14, wherein at least one of said baffles is slidably attached to another one of said baffles.

19. A refrigeration device according to claim 14, wherein detent means are provided to hold a first of said baffles in a fixed position relative to a second of said baffles.

20. A refrigeration device according to claim 14, wherein said at least one of said baffles is linearly movable.

21. A refrigeration device comprising:

a first and second compartment to be air chilled;

an air chilling apparatus;

a thermostat positioned in one of said compartments to control operation of said air chilling apparatus;

an air conduit extending between said air chilling apparatus and said two compartments;

air moving means to cause said chilled air to flow from said air chilling apparatus to said air conduit;

at least one opening in said air conduit communicating with each of said compartments;

a plurality of baffles in said air conduit to establish a fixed ratio of the air flowing into each of the compartments;

at least one of said baffles being selectively non-rotatably movable to vary said ratio, said at least one of said baffles being immovably fixed to a wall of said conduit and said wall being linearly movable.

22. A refrigeration device comprising:

a first and second compartment to be air chilled;

an air chilling apparatus;

a thermostat positioned in one of said compartments to control operation of said air chilling apparatus;

an air conduit extending between said air chilling apparatus and said two compartments;

air moving means to cause said chilled air to flow from said air chilling apparatus to said air conduit;

at least one opening in said air conduit communicating with each of said compartments;

a plurality of baffles in said air conduit to establish a fixed ratio of the air flowing into each of the compartments;

at least one of said baffles being selectively non-rotatably movable to vary said ratio;

wherein all of said baffles are immovably fixed to walls of said conduit.

* * * * *